US006152817A

United States Patent [19]

Daniels et al.

[11] Patent Number: 6,152,817

[45] Date of Patent: Nov. 28, 2000

[54] CHIMNEY COVER

[75] Inventors: Robert T. Daniels, Fairfield, Iowa; James E. Baynes, Plainfield, Ind.

[73] Assignee: Gelco Manufacturing, Inc., Aberdeen, N.C.

[21] Appl. No.: 09/103,143

[22] Filed: Jun. 23, 1998

[51] Int. Cl.[7] ..... F23L 17/12

[52] U.S. Cl. ..... 454/12; 454/35

[58] Field of Search ..... 454/12, 35

[56] References Cited

U.S. PATENT DOCUMENTS

| | | | |
|---|---|---|---|
| 776,642 | 12/1904 | Budd . | |
| 4,436,021 | 3/1984 | Hisey | 454/12 |
| 4,920,867 | 5/1990 | Joly . | |
| 5,402,613 | 4/1995 | Giumenta et al. | 454/12 X |
| 5,609,522 | 3/1997 | Szwartz . | |
| 5,842,918 | 12/1998 | Cowen | 454/12 |

FOREIGN PATENT DOCUMENTS

| | | | |
|---|---|---|---|
| 3829858 | 6/1989 | Germany | 454/12 |
| 9102 | of 1902 | United Kingdom | 454/35 |

*Primary Examiner*—Harold Joyce
*Attorney, Agent, or Firm*—James C. Nemmers

[57] ABSTRACT

A chimney cover that allows complete and unrestricted access to the chimney and flue liner without the necessity of removing any major component of the chimney cover from the chimney. The lid and spark arrestor cage are permanently secured together and then hinged in a suitable manner to a mounting frame that is secured to the chimney or to the flue liner. A positive locking device is provided so that the hinged lid and spark arrestor cage can be securely locked to the frame but easily unlocked so that the lid and cage can be swung out of the way to allow complete and unrestricted access to the chimney and flue.

18 Claims, 3 Drawing Sheets

FIG. 1
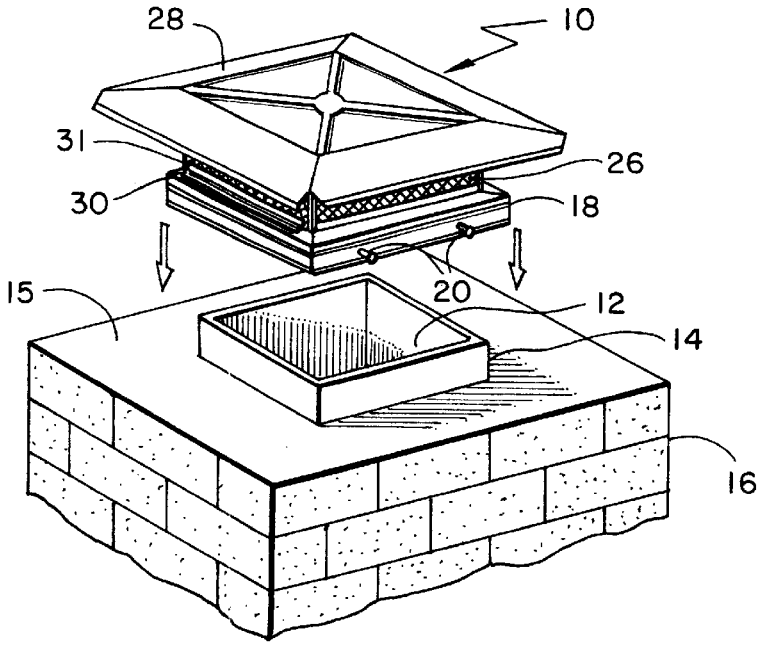
FIG. 3
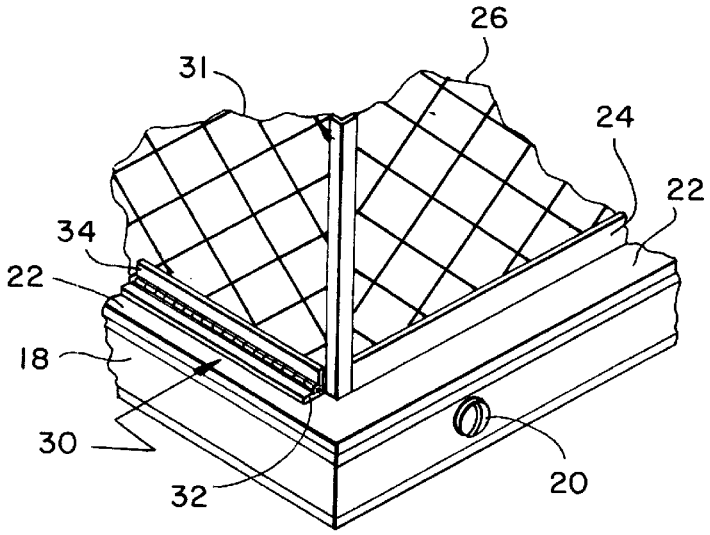
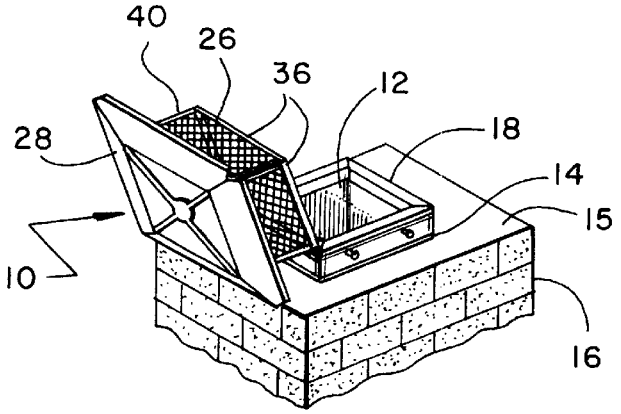
FIG. 2

FIG. 4
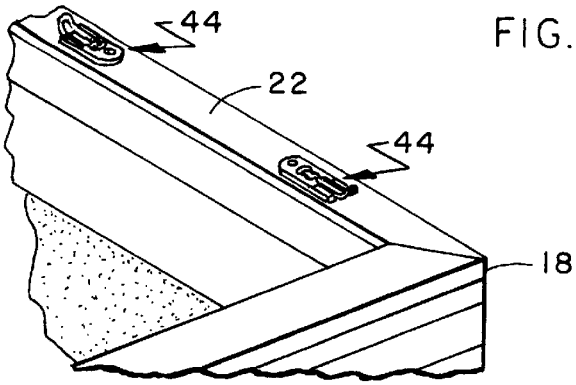
FIG. 5
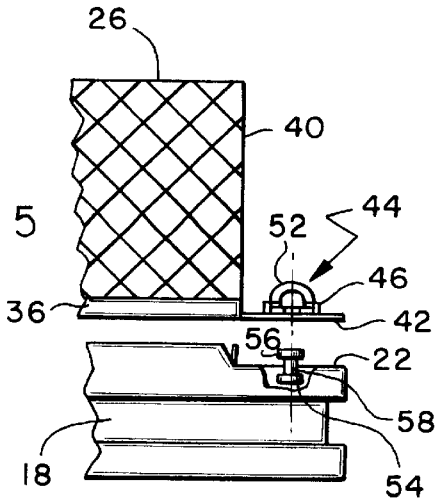
FIG. 6
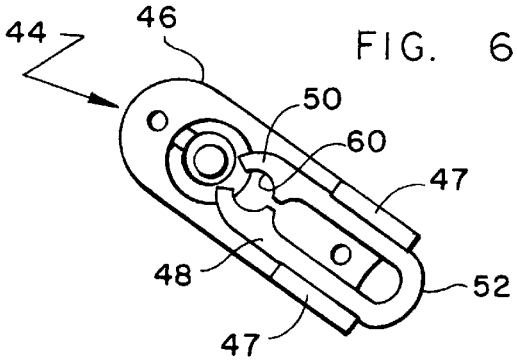
FIG. 7
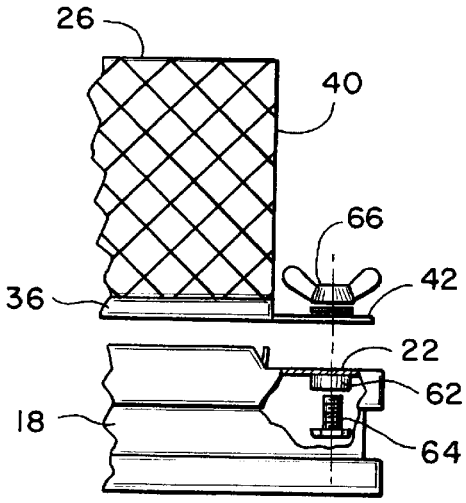
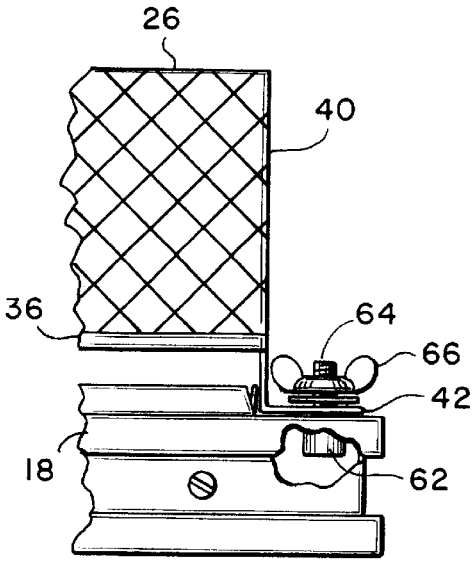
FIG. 8

FIG. 9
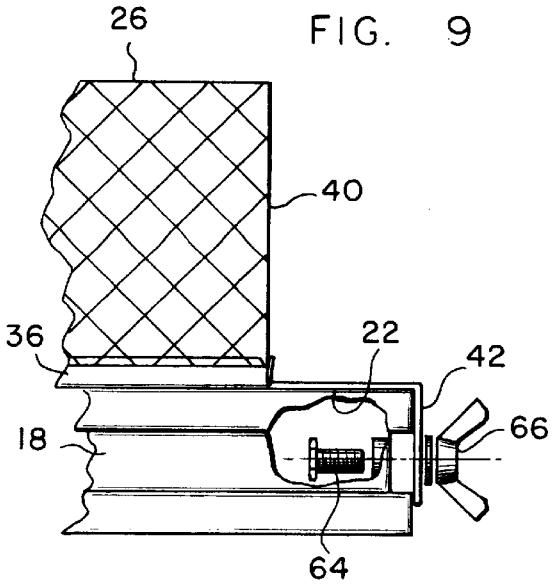
FIG. 11
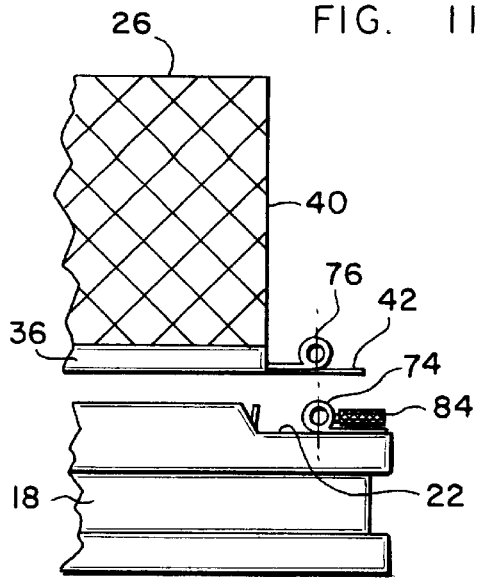
FIG. 10
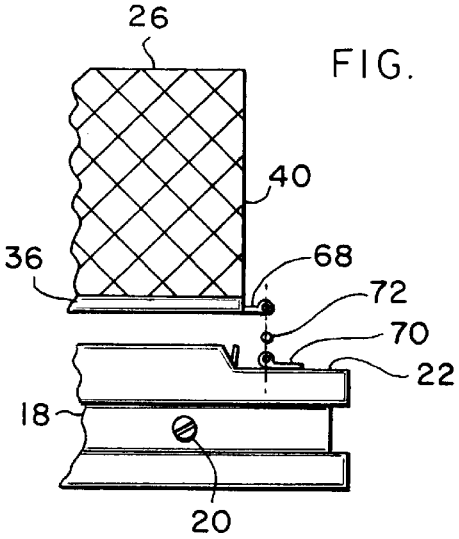
FIG. 12
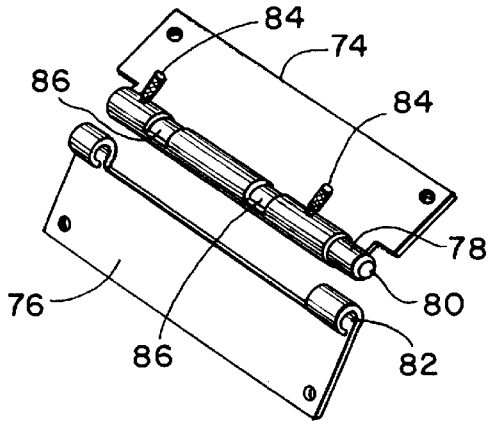
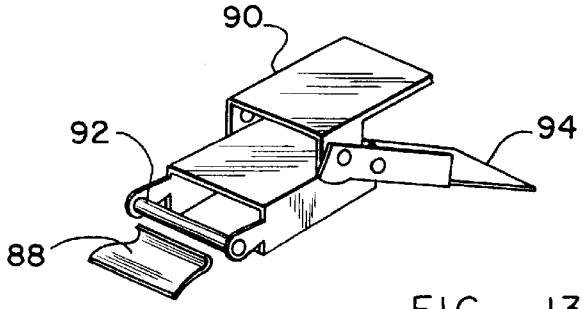
FIG. 13

CHIMNEY COVER

BACKGROUND OF THE INVENTION

This invention relates to chimney covers which are commonly used to cover the flue exhaust opening or openings in a chimney so as to prevent rain, snow, animals, birds, bats, debris, etc. from entering the flue while still permitting the flue gases to be exhausted. As is well known, a chimney commonly has one or more flue liners which extend above the top of the chimney, and the typical flue liner is generally rectangular in shape but may be any desired shape such as square, round or oval. The chimney cover has a means for mounting it on the chimney and typically has a mounting frame that is attached to the chimney crown or to the flue liner. The mounting frame supports a spark arrestor cage that is covered by a lid. The spark arrestor cage allows the flue gases to be exhausted while preventing the entry of animals, birds, etc. while the lid substantially minimizes the entry of rain or snow. Occasionally, when the flue is already protected from moisture but not from birds, animals, etc., the spark arrestor material used to form the sides of the cage also is used as the lid.

The presently known chimney covers serve their basic purposes quite well, but they do interfere with the work of chimney sweeps in cleaning the chimney. In order to properly clean the chimney, either the lid or the entire cover must be removed to provide complete access to the chimney. The chimney covers are therefore typically made so that the lid and/or the entire mounting frame, spark arrestor cage and lid can be removed during cleaning or repair of the chimney. Since most chimneys extend through pitched roofs, it is difficult for the chimney sweep to find a place to store the chimney cover while the chimney is being cleaned or repaired. With roofs that are steeply pitched, the cover and the fasteners for fastening the cover or lid can easily fall off the roof and become damaged or lost. The alternative is for the chimney sweep to remove the cover, climb down from the roof to temporarily store the cover and then return back to the roof to perform the cleaning operation. This obviously is inconvenient, requires extra time and effort and is costly to the sweep.

There are known a variety of ways of mounting the cover to the flue liner, the chimney or the chimney crown so as to make removal and replacement of the entire cover easier. It is also known to hinge the lid itself to the spark arrestor cage, but leaving the spark arrestor cage in place interferes with the work of the chimney sweep. Moreover, hinging the lid to the cage is somewhat difficult, since a positive locking device must be provided that is capable of securing the lid in a locked position that can resist the wind and other adverse weather conditions over a long period of time. Also, some chimney covers do not use a lid but only an animal control/spark arrestor screen. There is therefore a need for an improved design of chimney covers that satisfies the foregoing needs in a simple, easy way by providing unrestricted access to the chimney for cleaning or repair.

SUMMARY OF THE INVENTION

The invention provides a chimney cover that allows complete and unrestricted access to the chimney and flue liner without the necessity of removing any part of the chimney cover from the chimney. According to the invention, the lid and spark arrestor cage are permanently secured together and then hinged in a suitable manner to the mounting frame that is then secured to the chimney or to the flue liner. A positive locking device is provided so that the hinged lid and spark arrestor cage can be securely locked to the frame but easily unlocked so that the lid and cage can be swung out of the way to allow complete and unrestricted access to the chimney and flue. This allows the chimney sweep unobstructed access to clean or repair the chimney without the necessity of removing any components of the chimney cover and finding a place to temporarily store them while the chimney is being serviced.

BRIEF DESCRIPTION OF THE DRAWINGS

FIG. 1 is a perspective view showing a chimney cover constructed according to the principles of the invention with the chimney cover positioned above the chimney and ready to mount on the flue liner;

FIG. 2 is a perspective view similar to FIG. 1 showing the chimney cover of the invention mounted on the flue liner and with the lid and spark arrestor cage swung to the open position to allow access to the chimney;

FIG. 3 is an enlarged perspective view of a portion of the chimney cover to illustrate the hinge arrangement;

FIG. 4 is a perspective view of a portion of the chimney cover of the invention to illustrate the locking device;

FIG. 5 is a side elevational view of a portion of the chimney cover to further illustrate the locking device;

FIG. 6 is a perspective view of the locking device removed from the chimney cover;

FIG. 7 is a side elevational view, partially broken away, to illustrate another embodiment of the locking device;

FIG. 8 is a view similar to FIG. 7 and further illustrating another embodiment of the locking device;

FIG. 9 is a side elevational view similar to FIGS. 7 and 8 and further showing yet another embodiment of a locking device.

FIG. 10 is a view similar to FIGS. 7, 8 and 9 and illustrating a further embodiment of the locking device;

FIG. 11 is a side elevational view similar to FIGS. 7, 8, 9 and 10 and showing yet another embodiment of a locking device;

FIG. 12 is a perspective view illustrating the locking device of FIG. 11; and FIG. 13 is a perspective view of a further embodiment of a locking device suitable for use in connection with the chimney cover of the invention.

DESCRIPTION OF THE PREFERRED EMBODIMENTS OF THE INVENTION

Referring now to the drawings and first to FIGS. 1, 2 and 3, the chimney cover of the invention is indicated generally by the reference numeral 10. As is well known, the chimney cover 10 is designed to cover the opening 12 in the flue liner 14 of a chimney 16 so as to prevent the entry into the chimney of small animals, birds, debris from trees, rain, snow, etc. FIG. 1 shows the chimney cover 10 positioned above the flue liner 14 prior to its mounting on the chimney 16. The chimney cover 10 of the invention has a base or mounting frame 18 which in the illustrated embodiment is of a generally rectangular configuration sized to fit around the flue liner 14. As is well known to those skilled in the art, the mounting frame 18 may be any one of several types depending upon the particular chimney being protected. For example, in addition to the illustrated frame 18 attached to the flue liner 14, the frame 18 may be attached to the chimney 16 by securing it to the top of the chimney crown 15, around the outside of the chimney crown 15 or around the outside of the chimney 16 itself. Also, although a single square flue liner 14 is shown for purposes of illustration, it will be understood that the principles of the invention are applicable to any shape of flue liner, rectangular, round, oval, etc. The principles of the invention are also applicable to any type of mount, such as top mount, outside mount, flue mount as well as a mounting adapted to be secured to multiple flues, round or oval flues etc.

Regardless of the type of mounting, the frame 18 typically has four sides with at least two of the sides containing fasteners, such as cone-point screws 20, which are used to secure the frame 18 to the flue liner 14. Depending upon whether it is being mounted on the flue liner 14, the top or outside of the chimney crown 15 or around the chimney 16 itself, other types of fastening means may be used, such as mounting brackets, masonry screws, adjustable bands or strips and adhesives. With the invention, regardless of the type of mounting or fasteners used, once the chimney cover 10 is installed, it is expected that only rarely will there be any reason to remove the chimney cover 10, and thus the cone-point screws 20 are tightened so as to make a somewhat permanent installation but still allow the chimney cover to be removed if necessary.

The mounting frame 18 of the illustrated embodiment has an upper substantially horizontal ledge 22 on each of the sides of the frame. Depending upon the particular method of manufacture of the chimney cover 10, the interior edges of the ledge 22 can be formed so as to extend upwardly and thus provide mounting tabs 24 which can be used to secure the remainder of the chimney cover 10 to the mounting frame 18.

Affixed to the tabs 24 in any suitable manner, such as by welding, is the spark arrestor screen or cage 26 which is formed of any suitable material and which contains a plurality of openings. For example, the cage 26 may be formed of an expanded wire mesh, welded strips or bands of sheet material, or sheet material with a plurality of holes stamped in the material. In any event, the openings are small enough to prevent entry of undesirable creatures and debris while still permitting the maximum amount of air and gases to be exhausted from the chimney through the cage 26. The cage 26 is, of course, formed with four sides corresponding to the sides of the mounting frame 18.

Secured to the cage 26 is a lid 28, which preferably is sufficiently large so that the outer edges of the lid 28 completely shelter and extend beyond the opening in the flue liner 14. Also, the outer edges of the lid 28 are preferably sloped downwardly so that rain and snow will run off of the lid 28. In addition, the sloping top of the lid 28 provides added strength to the lid 28 which is preferably made of sheet material.

To provide access into the chimney and the inside of the flue liner 14, the lower edge along one side 31 of the cage 26 is pivotally mounted to the mounting frame 18 in any suitable manner. As shown in the drawings, a hinge 30, preferably a piano-type hinge, has one leg 32 welded or otherwise suitably affixed to the top surface of the ledge 22 of the mounting frame 18 while the upper leg 34 of the hinge 30 is securely attached, preferably by welding, to the lower edge of the side 31 of the cage 26. The two sides of the cage 26 adjacent to the hinged side 31 also preferably have a reinforcing member 36 welded or otherwise suitably affixed to the bottom edge of the cage 26. These reinforcing members 36 add rigidity to the cage 26, especially where the cage 26 is formed from expanded wire mesh material.

On the side 40 of the cage 26 that is opposite the hinged side 31, there is affixed an outwardly extending flange 42 that provides a mounting for a locking device indicated generally by the reference numeral 44. FIGS. 4, 5 and 6 show a preferred form of the locking device which is a slide latch 44. The slide latch 44 has a base 46 attached to the flange 42 that extends outwardly from the cage 26. The base 46 has two longitudinally extending guides 48 into which there is received a slideable catch 48 that has an open jaw 50 at one end and an upwardly extending operating tab 52 that can be gripped to move the catch 48 forwardly and rearwardly within the guides 47. Attached to the ledge 22 of the mounting frame 18 are upwardly extending eyelets 54 which contain a head 56 that is wider than the cylindrical body 58 of the eyelet 54. The diameter of the cylindrical body 58 is sized so that it will be engaged by the jaw 50 of the slideable catch, which jaws 50 will spread slightly until the cylindrical body 58 of eyelet 54 is captured within the circular locking opening 60 that forms a part of the jaw 50. As shown in the drawings, there are preferably provided two locking latches 44 so as to provide a positive lock to maintain the cover 10 in a closed position except when it is desired to obtain access to the inside of the chimney. However, the number of locking latches 44 and their position and spacing depends upon the size and type of the chimney cover 10.

FIGS. 7, 8 and 9 show additional embodiments of a locking device to maintain the chimney cover 10 in a closed position and assure a positive lock. FIG. 7 illustrates the use of a weld nut 62 through which extends upwardly a cap screw 54 on which is threaded a wing nut and washer 66. The weld nut 62 and cap screw 54 could also be made in one piece to form a weld stud if desired. When this locking device is used, an opening is formed in the flange 42 to receive the cap screw 64.

FIG. 8 illustrates the use of the locking device shown in FIG. 7, but in the embodiment of FIG. 8, the flange 42 extends first downwardly from the center cage and then outwardly.

In the embodiment of FIG. 9, the flange 42 extends outwardly and then downwardly and around the mounting frame 18 with the locking device consisting of the cap screw 64 and wing nut 66 being received through the side edge of the mounting frame 18 rather than the ledge 22 of frame 18.

FIG. 10 illustrates yet another embodiment of a locking device which utilizes a hinge, such as a piano hinge. The ledge 42 extending outwardly from the cage 26 is the upper half 68 of a hinge with the lower half 70 being secured to the ledge 22 of the mounting frame 18 and aligned with the upper half 68 so that the two halves will mesh when the chimney cover 10 is closed. A hinge pin 72 is then inserted through the upper half 68 and lower half 70 to securely lock the chimney cover in a closed position. The hinge may extend substantially the entire length along the ledge 22 of the cage 26 or the hinge may be split into one or more pieces that form separate hinges. The number and placement of the hinges depends upon the size and type of chimney cover 10.

FIGS. 11 and 12 illustrate yet another embodiment of the locking device for the chimney cover. FIG. 12 illustrates a spring-loaded catch that consists of a lower plate 74 welded, riveted or otherwise suitably affixed to the top of the ledge 22 and an upper plate 76 affixed to the flange 42. Moveable from side to side within the lower plate 74 is a locking rod that is spring biased to a closed or locked position (see position in FIG. 12) in which the outer end 80 is engaged within the locking lug 82 formed on the upper plate 76. The locking rod 78 is slideable from a locked to an unlocked position by grasping one of the operating handles 84 which slide in grooves (not shown) in the lower plate 74. The locking rod 78 can be held in an unlocked position against the bias of the spring by moving the operating handles 84 into the openings 86. If desired, the locking device of this embodiment can be made without being spring biased.

FIG. 13 illustrates yet another embodiment of a suitable locking device to maintain the chimney cover 10 in a closed position. As illustrated in FIG. 13, the locking plate 88 has an upwardly curved outer end, and the plate 88 is affixed to the ledge 22 of the mounting frame 18. Preferably, the flange 42 is formed in a manner illustrated in FIG. 8 in which the flange extends first downwardly and then outwardly over the ledge 22. The latch assembly 90 includes a locking bar 92 that can be engaged with and disengaged from the locking plate 88 by use of the over-the-center cam locking mechanism which includes the operating tab 94.

The operation and use of the hinged chimney cover 10 should be evident from the foregoing description. After installation of the chimney cover 10 on the chimney 16 in the manner described herein by tightening the cone-point screws 20 into the outside of the flue liner 14, the chimney cover 10 is closed and locked into position using the locking device 44. Any of the locking devices of the various embodiments disclosed herein will work satisfactorily, and the number of locking devices and their position and spacing depends upon the size and type of the chimney cover 10. The preferred locking device is that illustrated in FIGS. 4, 5 and 6 using a sliding latch mechanism. Once closed and locked, it is virtually impossible for the chimney cover 10 to be swung to an open position without manually unlocking the locking device 44. When it is desired to gain access to the interior of the chimney 16 so as to clean the flue liner 14, for example, the locking device 14 is unlatched and the cage 26 and lid 28 are swung as a unit through an arc of at least 90° to provide unrestricted access to the interior of the chimney 16. If the ledges 22 of the mounting frame 18 are sloped slightly downwardly, the cage 26 and lid 28 can be swung beyond 90°. When it is desired to close the chimney cover 10, the cage 26 and lid 28 are swung back to the closed position and the locking device 24 engaged to maintain the chimney cover in its closed position. There is no necessity to remove the entire chimney cover 10 and find a place to temporarily store it during cleaning of the chimney 16. Moreover, there are no components that can become detached or separated from the chimney cover 10 except for possibly the wing nuts or the piano hinge pin that might be used in some of the embodiments of the locking device. However, these can be easily placed in one's pocket.

The chimney cover of the invention can of course be made of any suitable material, such as copper, galvanized sheet metal or stainless steel, which is the preferred material because of its strength and resistance to corrosion. Some plastics may also be suitable for this application.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A chimney cover for covering the open top of a chimney having one or more flue liners, said chimney cover comprising: a mounting frame for securing the cover directly to the chimney or to a portion of the chimney such as the flue liner, the mounting frame having opposite sides each engageable with that portion of the chimney to which the cover is adapted to be secured, fastening means for securing the mounting frame to that portion of the chimney to which the cover is adapted to be fastened, a spark arrestor cage having side members joined to the mounting frame and extending upwardly from the mounting frame so as to cover at least a portion of the open top of the chimney, and pivot means pivotally connecting one of the side members of the arrestor cage to one of the sides of the mounting frame so as to provide for swingable movement of the cage from a closed position covering the open top of the chimney to an open position in which free access is provided into the open top of the chimney.

2. The chimney cover of claim 1 in which a solid lid is mounted on and secured to the top of the spark arrestor cage to minimize entry of rain, snow and the like into the chimney, the lid and spark arrestor cage being swingable as a unit from a closed position covering the open top of the chimney to an open position in which free access is provided into the open top of the chimney.

3. The chimney cover of claim 2 in which the lid extends outwardly at least beyond the sides of the spark arrestor cage.

4. The chimney cover of claim 3 in which the lid is sloped downwardly and outwardly.

5. The chimney cover of claim 1 in which the spark arrestor cage is made of expanded wire mesh.

6. The chimney cover of claim 1 in which a manual locking device is combined with the mounting frame and the side of the spark arrestor cage opposite the side to which the pivot means is connected to lock the spark arrestor cage to the mounting frame when the cage is in a closed position.

7. The chimney cover of claim 6 in which the locking device includes threaded members combined with the spark arrestor cage and the mounting frame to releaseably lock the spark arrestor cage to the mounting frame when the cage is in the closed position.

8. The chimney cover of claim 6 in which the locking device includes a hinge having a hinge pin combined with the spark arrestor cage and the mounting frame, the hinge pin being removable from the hinge to unlock the device and provide for swingable movement of the cage from the closed position to the open position.

9. The chimney cover of claim 6 in which the locking device includes a slideable locking rod and locking lug combined with the spark arrestor cage and the mounting frame, the locking rod being slideable into and out of the locking lug to secure the cage to the mounting frame when in the closed position and to provide for swingable movement of the cage from the closed position to the open position.

10. The chimney cover of claim 2 in which a manual locking device is combined with the mounting frame and the side of the spark arrestor cage opposite the side to which the pivot means is connected to lock the spark arrestor cage to the mounting frame when the cage is in a closed position.

11. The chimney cover of claim 10 in which the locking device includes threaded members combined with the spark arrestor cage and the mounting frame to releaseably lock the spark arrestor cage to the mounting frame when the cage is in the closed position.

12. The chimney cover of claim 10 in which the locking device includes a hinge having a hinge pin combined with the spark arrestor cage and the mounting frame, the hinge pin being removable from the hinge to unlock the device and provide for swingable movement of the cage from the closed position to the open position.

13. The chimney cover of claim 10 in which the locking device includes a slideable locking rod and locking lug combined with the spark arrestor cage and the mounting frame, the locking rod being slideable into and out of the locking lug to secure the cage to the mounting frame when in the closed position and to provide for swingable movement of the cage from the closed position to the open position.

14. The chimney cover of claim 13 in which the locking rod is spring biased into a locking position with the locking lug.

15. The chimney cover of claim 10 in which the locking device includes an over-the-center cam locking mechanism.

16. The chimney cover of claim 1 in which the pivot means pivotally connecting one of the side members of the arrestor cage to one of the sides of the mounting frame is a piano-type hinge.

17. A chimney cover for covering the open top of a chimney having one or more flue liners, said chimney cover comprising: a mounting frame for securing the cover directly to the chimney or to a portion of the chimney such as the flue liner, the mounting frame having opposite sides each engageable with that portion of the chimney to which the cover is adapted to be secured, fastening means for securing the mounting frame to that portion of the chimney to which the cover is adapted to be fastened, a spark arrestor cage having side members joined to the mounting frame and extending upwardly from the mounting frame so as to cover at least a portion of the open top of the chimney, pivot means pivotally connecting one of the side members of the arrestor cage to one of the sides of the mounting frame so as to provide for swingable movement of the cage from a closed position covering the open top of the chimney to an open position in which free access is provided into the open top of the chimney, and a manual locking device combined with the mounting frame and the side member of the spark arrestor cage opposite the side member to which the pivot means is connected to lock the spark arrestor cage to the mounting frame when the cage is in a closed position.

18. A chimney cover for covering the open top of a chimney having one or more flue liners, said chimney cover comprising: a mounting frame for securing the cover directly to the chimney or to a portion of the chimney such as the flue liner, the mounting frame having opposite sides each engageable with that portion of the chimney to which the cover is adapted to be secured, fastening means for securing the mounting frame to that portion of the chimney to which the cover is adapted to be fastened, a spark arrestor cage having side members joined to the mounting frame and extending upwardly from the mounting frame so as to cover at least a portion of the open top of the chimney, pivot means pivotally connecting one of the side members of the arrestor cage to one of the sides of the mounting frame so as to provide for swingable movement of the cage from a closed position covering the open top of the chimney to an open position in which free access is provided into the open top of the chimney, a solid lid mounted on and secured to the top of the spark arrestor cage to minimize entry of rain, snow and the like into the chimney, the lid and spark arrestor cage being swingable as a unit from a closed position covering the open top of the chimney to an open position in which free access is provided into the open top of the chimney, a manual locking device combined with the mounting frame and the side of the spark arrestor cage opposite the side to which the pivot means is connected to lock the spark arrestor cage to the mounting frame when the cage is in a closed position, the locking device including an eyelet attached to the mounting frame, and a base attached to the spark arrestor cage, the base having a slideable catch adapted to engage the eyelet to lock the cage to the mounting frame when the cage is in the closed position.

* * * * *